United States Patent [19]

Renaud et al.

[11] 4,199,482

[45] Apr. 22, 1980

[54] LAUNDRY PRE-SPOTTER COMPOSITION AND METHOD OF USING SAME

[75] Inventors: Jean Renaud, Bougival; Seugnet Monique, Colombes, both of France

[73] Assignee: Colgate-Palmolive Company, New York, N.Y.

[21] Appl. No.: 950,498

[22] Filed: Oct. 11, 1978

Related U.S. Application Data

[63] Continuation of Ser. No. 777,992, Mar. 31, 1977, abandoned.

[51] Int. Cl.[2] ..... C11D 1/831; C11D 3/44

[52] U.S. Cl. ..... 252/559; 8/137; 252/174.21; 252/558; 252/171; 252/DIG. 14

[58] Field of Search ..... 8/142; 252/153, 162, 252/170, 171, 558, 559, 550, 551, 555, DIG. 14

[56] References Cited

U.S. PATENT DOCUMENTS

| | | | |
|---|---|---|---|
| 3,625,909 | 12/1971 | Berg et al. | 252/153 |
| 3,628,911 | 12/1971 | Grunewalder | 8/142 |
| 3,664,962 | 5/1972 | Kelley et al. | 252/125 |
| 3,701,627 | 10/1972 | Grunewalder | 8/142 |
| 3,764,544 | 10/1973 | Haworth | 252/170 |
| 3,872,021 | 3/1975 | McKnight | 252/121 |

FOREIGN PATENT DOCUMENTS

| | | | |
|---|---|---|---|
| 705862 | 3/1965 | Canada | 252/171 |
| 1144427 | 2/1963 | Fed. Rep. of Germany | 252/153 |
| 1397475 | 6/1975 | United Kingdom | 252/170 |

*Primary Examiner*—P. E. Willis, Jr.
*Attorney, Agent, or Firm*—Norman Blumenkopf; Herbert S. Sylvester; Murray M. Grill

[57] ABSTRACT

This invention relates to a laundry pre-spotter composition comprising a solvent for greasy materials, a chlorinated solvent, an organic solvent, water, and a mixture of nonionic and anionic surface active agents and the method of using the same, the composition being in the form of a clear, compatible, homogeneous, stable liquid.

6 Claims, No Drawings

LAUNDRY PRE-SPOTTER COMPOSITION AND METHOD OF USING SAME

This is a continuation, of application Ser. No. 777,992 filed Mar. 31, 1977, now abandoned.

BACKGROUND OF THE INVENTION

This invention relates to a laundry pre-spotter composition effective for the removal of stains on fabrics, and the method of using same. More specifically, the present invention relates to a pre-spotter composition which comprises a suitable combination of a plurality of solvents and a nonionic surface active agent which may be admixed with an anionic surface active agent as an additional ingredient.

The removal of certain kinds of stains, particularly greasy stains, organic or inorganic, has been and still remains a problem for the consumer. Suggested solutions consist of reinforcing the washing conditions, such as increasing the concentration of the detergent, increasing the temperature of the washing solution, or increasing the agitation. However, these efforts are not always sufficient or desirable since they may cause damage to the fabrics. For delicate fabrics, the above-listed suggestions cannot be applied since delicate fabrics must be washed at low temperatures and agitation. Furthermore, a stain is localized to a particular spot on the fabric and it would be illogical and wasteful to treat the entire item to wash out one stain.

Late in the nineteen sixties, some pre-spotters which were to be used on stains prior to washing appeared on the U.S. market. These pre-spotters usually contain mixtures of surface active materials and solvents used for dry cleaning. The solvent assists in dissolving some components of the stains while the surface active agent emulsifies or solubilizes the components which are soluble in water but not dissolved by the solvent. The surface active agent also helps against soil redeposition by modifying the surface tension at the soil—fabric interface.

Most soils or stains deposited on fabrics may be listed in three groups: (1) solvent soluble soils, e.g., human sebum and its degradation products; (2) water soluble soils, e.g., perspiration, food and so forth; and (3) insoluble soils, e.g., dust. This explains why one chemical cannot be expected to be efficient on all types of soils.

The present invention is directed to a specially formulated pre-spotter composition which is more efficient on a broad spectrum of stains than presently available pre-spotters.

PRIOR ART

Although stain-removing compositions have been proposed, such compositions do not provide the ability to clean or remove a wide range of stains. For example, the composition disclosed in U.S. Pat. No. 3,664,962 comprising benzyl alcohol entrained in a sodium stearate matrix is effective in removing ball-point pen ink. A stain-removing composition comprising water, a liquid hydrocarbon solvent, a surface active agent, an organic co-solvent, and a solid, non-tacky water dispersible anti-soiling agent, is proposed in U.S. Pat. No. 3,748,268. However, this composition is for cleaning carpets and upholstery which cannot be soaked or washed in cleaning baths. Another example of a cleaning solution comprising water, organic solubilizing agents, surfactants, a hydrocarbon solvent, a chlorinated solvent and an inorganic builder is shown in U.S. Pat. No. 3,915,902. However, this composition is primarily for cleaning and not for pre-treating stained fabrics. The combination of anionic and nonionic detergents is known, as exemplified in U.S. Pat. No. 3,812,041.

SUMMARY OF THE INVENTION

The present invention provides a novel laundry pre-spotter composition having improved efficiency in removing a broad spectrum of stains over presently available pre-spotters.

The present invention further provides a process for removing stains and soil from fabrics by first treating the fabrics with a novel pre-spotter composition and subsequently laundering the fabrics with detergents.

DETAILED DESCRIPTION OF INVENTION

In accordance with the present invention, a novel laundry pre-spotter composition is provided. The pre-spotter composition comprises from about 10% to about 40% by weight of a solvent for greasy material, from about 5% to about 35% by weight of a chlorinated solvent, from 0% to about 30% by weight of an organic solvent, from 0% to about 40% by weight of water, from about 5% to about 40% by weight of at least one nonionic surface active agent, and optionally, from 0% to 15% by weight of at least one anionic surface active agent. The pre-spotter composition has a pH of from 7 to 9.

The solvent for greasy materials is present in the amount of from about 10% to about 40% by weight, preferably from about 20% to about 30% by weight. Suitable examples of the solvent for greasy materials include benzyl alcohol and $\beta$-phenylethyl-alcohol, with benzyl alcohol being preferred.

The chlorinated solvent is present from about 5% to about 35% by weight, preferably from about 10% to about 25% by weight. Suitable chlorinated solvents include chlorine substituted aliphatic hydrocarbons having 1 to 6 carbon atoms which are liquid at room temperature. Examples of such solvents are methylene chloride; ethylene dichloride; carbon tetrachloride; 1,2-dichloroethane; 1,1,1-trichloroethane; 1,3-dichloropropane; chloroform; 1,4-dichlorobutane; perchloroethylene; and trichloroethylene. Among these, perchloroethylene and 1,1,1-trichloroethane are preferred, with perchloroethylene being most preferred.

The organic solvent utilized in the present pre-spotter composition can range from 0% to about 30% by weight with from about 2% to about 25% by weight being preferred and 5% to 20% being most preferred. Examples of useful organic solvents include low molecular weight glycols, such as ethylene glycol, propylene glycol, and butylene glycol, with propylene glycol being preferred.

The water used in the composition of this invention ranges from about 2% to about 40% by weight, preferably from about 5% to about 30% by weight. The water used is either deionized or distilled water.

The amount of nonionic surface active agents used in the present composition ranges from about 5% to about 40% by weight, preferably from about 10% to about 30% by weight. The choice of particular nonionic surface active agents is not restricted, i.e., any of the well-known nonionic surface active agents may be used. Examples of conventional nonionics include those surface active or detergent compounds which contain an organic hydrophobic group and a hydrophilic group which is a reaction product of a solubilizing group such as carboxylate, hydroxyl, amido or amino with an alkylene oxide e.g., ethylene oxide or with the polyhydration product thereof e.g., polyethylene glycol.

As examples of such nonionic surface active agents there may be noted the condensation product of alkyl phenol with ethylene oxide, e.g., the reaction product of nonyl phenol with about 6–30 ethylene oxide units; condensation products of alkyl thiophenols with 10–15 ethylene oxide units; condensation products of higher fatty alcohols such as tridecyl alcohol with ethylene oxide; ethylene oxide addends of monoesters of hexahydroic alcohols and inner ethers thereof such as sorbitan monolaurate, sorbitol monooleate and mannitan mono palmitate, and the condensation products of polypropylene glycol with ethylene oxide.

Other nonionics include the alkylolamine condensates of higher fatty acids, such as lauric and myristic mono- and di-ethanolamide; the higher alkyl amine oxides such as lauryl di-methyl amine oxide, lauryl bis (hydroxy ethyl) amine oxide; higher alkyl mono- and di-sulfoxides, phosphine oxides and the like.

Among the above-listed nonionics, those of the ethoxylated alcohol type are preferred. Most preferred is an ethoxylated alcohol having 12 to 15 carbons and an ethylene oxide ratio of 7:1. Although it is preferred to use only nonionic surface active agents, the pre-spotter composition may optionally include at least one anionic surface active agent, in the amount of from 0% to about 15% by weight, preferably from 0% to about 10% by weight. In this instance, the anionics merely act as boosters. The choice of suitable anionics is not particularly restricted. Useful anionics include those surface active or detergent compounds which contain an organic hydrophobic group and an anionic solubilizing group. Typical examples of anionic solubilizing groups are sulfonate, sulfate, carboxylate, phosphonate and phosphate. Examples of suitable anionic detergents which fall within the scope of the invention include soaps such as the water soluble salts of higher fatty acids or rosin acids such as may be derived from fats, oils and waxes of animal, vegetable or mineral origin e.g., the sodium soaps of tallow, grease, coconut oil, tall oil and mixtures thereof; and the sulfates and sulfonated synthetic detergents particularly those having at least 8 and about 8 to 30, and preferably about 12 to 22 carbon atoms, in the molecular structure.

As examples of suitable, synthetic anionic detergents there may be cited the higher-alkyl mononuclear aromatic sulfonates such as the higher-alkyl benzene sulfontes containing from 10 to 16 carbon atoms in the alkyl group in a straight or branched chain e.g., the sodium salts of higher alkyl benzene sulfonates or of the higher-alkyl toluene, xylene, and phenol sulfonates; alkyl toluene, xylene, and phenol sulfonates; alkyl naphthalene sulfonate, ammonium diamyl naphthalene sulfonate, and sodium dinonyl naphthalene sulfonate. Mixed long chain alkyls derived from coconut oil, fatty acids and the tallow fatty acids can also be used along with cracked paraffin wax olefins and polymers of lower monoolefins. In one preferred type composition there is used a linear alkyl benzene sulfonate having a high content of 3- (or higher) phenyl isomers and a correspondingly low content (well below 50%) of 2- (or lower) phenyl isomers; in other terminology the benzene ring is preferably attached in large part at the 3 or higher (e.g. 4,5,6, or 7) position of the alkyl group and the content of isomers at which the benzene ring is attached at the 2 or 1 position is correspondingly low.

Other anionic detergents are the olefin sulfonates including long chain alkene sulfonates, long chain hydroxy alkane sulfonates or mixtures of alkene-sulfonates and hydroxy alkane-sulfonates. These olefin sulfonate detergents may be prepared in known manner by the reaction of $SO_3$ with long chain olefins (of 8–25 and preferably of 12–21 carbon atoms) of the formula $RCH{=}CH\ R_1$, where R is alkyl and $R_1$ is alkyl or hydrogen to produce a mixture of sultones and alkene sulfonic acids which mixture is then treated to convert the sultones to sulfonates. Especially good characteristics are obtained by the use of a feed stock containing a major proportion i.e., above 70%, and preferably above 90%, of alpha olefins. Examples of such products are $C_{14}$ alpha olefin sulfonate, $C_{16}$ alpha olefin sulfonate, etc. Examples of other sulfate or sulfonate detergents are paraffin sulfonates such as the reaction products of alpha olefins and bi-sulfites (e.g., sodium bi-sulfite), e.g., primary paraffin sulfonates of about 10–20, preferably about 15–20 carbon atoms; e.g., sodium n-pentadecane sulfonate, sodium n-octadecyl sulfonate, sulfates of higher alcohol; salts of alphasulfo fatty esters (e.g., of about 10–20 carbon atoms, such as metal alpha-sulfo myristate or alphasulfo tallowate).

Examples of sulfates of higher alcohols are sodium lauryl sulfate, sodium tallow alcohol sulfate; turkey red oil or other sulfated oils, or sulfates of mono- or diglycerides of fatty acids (e.g., stearic mono-glyceride mono-sulfate), alkyl condensation products of ethylene oxide and lauryl alcohol (e.g., with 1–20 ethylene oxide groups per molecule); lauryl or other higher sulfates such as the sulfates of the condensation products of ethylene oxide and nonyl phenol (e.g., having 1–10 ethylene oxide groups per molecule and usually from 2–10 such groups).

The suitable anionic detergents include also the acyl sarcosinates (e.g., sodium lauroyl sarcosinate), the acyl esters (e.g., oleic acid ester) of isethionates, and the acyl N-methyl taurides (e.g., potassium N-methyl lauroyl or oleoyl tauride). In each instance, the acyl moieties usually vary from fatty $C_{10}$ to $C_{20}$ and preferably $C_{12}$ to $C_{16}$.

The most highly preferred water soluble anionic detergent compounds are the ammonium and substituted ammonium (such as mono, di- and tri-ethanolamine), alkali metal such as sodium and potassium and alkaline earth metal (such as calcium and magnesium) salts of the higher alkyl benzene sulfonates, olefin sulfonates and higher alkyl sulfates. Among the above-listed anionics, the most preferred are the sodium alkyl benzene sulfonates (LAS).

The pre-spotter composition may further contain a solubilizer in such an amount so as to keep the liquid mixture stable, homogeneous and transparent when aged at temperatures ranging from −4° C. to 43° C. Examples of suitable solubilizers are urea, sodium xylene sulfonate and sodium cumene sulfonate, with urea being preferred since it ensures better formula stability at low temperatures. The amount of solubilizer used in the composition is up to about 10% by weight, preferably about 6% by weight.

Various supplemental ingredients, which are optional but desirable, can be included in the present pre-spotter composition. These comprise, for example, germicides, coloring dyes, perfumes, and the like, all of which, when utilized, are employed in small amounts, most of them below 1% by weight of the composition.

The composition can be formed by admixing the above-listed ingredients in any sequence. However, the following sequence is preferred. The nonionic surface active agent is mixed with the organic solvent. The anionic surface active agent, if used, is dissolved in water. This anionic/water solution is then mixed with the nonionic/organic solvent solution. To the resulting solution, the solvent for greasy materials is added. The solubilizer, if used, is then dissolved in water and added to the mixture. Lastly, the chlorinated solvent is added to form the final product.

According to the process of the present application, the above pre-spotter composition may be applied to the fabric by any of a number of methods. The solution may be sprayed onto the fabric by means of either a mechanical spraying apparatus including a pump or an aerosol spray wherein the composition includes a small portion of an aerosol propellant, such as, for example, nitrous oxide, carbon dioxide, isobutane, and polar hydrocarbon and chlorinated propellants. The composition may also be sprinkled on the fabrics although an even, finely dispensed spray is preferred.

The composition is sprayed onto the fabric either covering the entire fabric if the same is heavily soiled or only upon those areas which require special pre-treatment. Subsequent to the spraying, the fabrics may be washed in any conventional manner utilizing either nonionic, cationic or anionic detergents or soaps.

Although it is preferred to use the composition as a pre-spotter, i.e., treating the stain just prior to washing, the composition may also be used as a stain-remover. In this instance, the composition is applied to the stain on the fabric and the solvents are allowed to evaporate.

The process and composition of the present invention will now be illustrated by way of the following examples. It must be noted that these examples are for illustration purposes and are not to be taken as limiting.

EXAMPLES 1-15

The pre-spotter composition of the present invention having the ingredients shown in Table I was formed by mixing such ingredients in the same order as they are listed (Formula I)

TABLE I

| Ingredients | Weight % |
|---|---|
| Dobanol 25 - 7* | 15.6 |
| Propylene glycol | 13.8 |
| Water | 10.8 |
| LAS | 2.1 |
| Benzyl alcohol | 26.1 |
| Urea | 6 |
| Water | 10 |
| Perchloroethylene | 15.6 |

*an ethoxylated alcohol having 12 to 15 carbons and an ethylene oxide ratio of 7:1

A 10×12 cm cotton swatch was artificially soiled in a uniform way. Fifteen commonly encountered stains were deposited on the swatches. Then, 0.12 gm of Formula I was applied to the swatches. After a contact time of 1½ minutes, the swatches were laundered in a Tergotometer (300 ppm water, 2 g/l of French Gamma detergent, wash temperature at 80° C. for 10 minutes and 4 swatches per beaker). After rinsing and drying, the swatches were read on a Gardner Reflectometer at two places, one where the pre-spotter was applied ($D_1$) and the other where the pre-spotter was not applied ($D_2$). Stain removal due to the pre-spotter was expressed by $\Delta = D_1 - D_2$.

Comparative experiments were conducted with a commercially available pre-spotter composition containing 15% nonionics (ethoxylated fatty alcohol) and 85% petroleum distillation. (Formula II). The procedure used in Examples 1-15 was repeated with the exception that Formula II was used.

The results are summarized in Table II, where "comparative efficiency" of the formulae was used in order to eliminate the effects of the concentration of the soil. In Table II, the following code was used:

++ positive effect, superior to that of other product
+ positive effect
0 no effect
− negative effect, stain reset by the prespotter.

TABLE II

| Example | Stains | Formula I | Formula II |
|---|---|---|---|
| 1 | Ink | ++ | + |
| 2 | Shoe Polish | ++ | + |
| 3 | Blood | ++ | + |
| 4 | Spangler | + | + |
| 5 | Tomato Sauce | + | + |
| 6 | Gouache Lilac | + | − |
| 7 | Gouache Pink | + | − |
| 8 | Chocolate + Milk | + | − |
| 9 | Coffee + Milk | + | 0 |
| 10 | Gravy | + | 0 |
| 11 | Wine | + | 0 |
| 12 | Apricot | + | 0 |
| 13 | Black Current | + | 0 |
| 14 | Raspberry | + | 0 |
| 15 | Grapes | + | 0 |

The results in Table II show that Formula I was efficient on all listed stains whereas Formula II was less efficient in Example 1-3, no effect in Example 9-15, and undesirable effect in Example 6-8, where the stains were reset rather than removed.

The results of Table II clearly indicate the superiority of Formula I, the composition of the present invention.

What is claimed is:

1. A laundry pre-spotter composition comprising:
(1) from about 10% to about 40% by weight of a solvent for greasy material selected from the group consisting of benzyl alcohol and B-phenylethylalcohol;
(2) from about 5% to about 35% by weight of a chlorine substituted aliphatic hydrocarbon solvent having from 1 to 6 carbon atoms and being a liquid at room temperature;
(3) from 5% to about 20% by weight of an organic solvent selected from the group consisting of ethylene glycol, propylene glycol, and butylene glycol;
(4) from about 5% to about 40% by weight of at least one nonionic surface active agent;
(5) from 5% to about 30% by weight of water; and
(6) from 0 to about 10% by weight of at least one anionic surface active agent;

the composition in the forms of a clear, compatible, homogeneous, stable liquid having a pH of 7 to 9.

2. The composition of claim 1 wherein component (2) is selected from the group consisting of methylene chloride; ethylene dichloride; carbon tetrachloride; 1,2-dichloroethane; 1,1,1-trichloroethane; 1,3-dichloropropane; chloroform; 1,4-dichlorobutane; perchloroethylene; and trichloromethylene.

3. The composition of claim 1 wherein component (1) is from about 20% to about 30% by weight; component (2) is from about 10% to about 25% by weight and selected from the group consisting of perchloroethylene and 1,1,1-trichloroethane; component (3) is from about 10% to about 20% by weight; and component 5 is from about 10% to about 30% by weight.

4. The composition of claim 3 wherein component (1) is benzyl alcohol, component (2) is perchloroethylene, and component (3) is propylene glycol.

5. The composition of claim 4 wherein component (1) is benzyl alcohol and present at about 26.1% by weight; component (2) is perchloroethylene and present at about 15.6% by weight, component (3) is propylene glycol and present at about 13.8% by weight; component (5) is present at about 20.8% by weight; component (4) is an ethoxylated alcohol having 12 to 15 carbon atoms and an ethylene oxide to alcohol ratio of 7:1 and present at about 15.6% by weight; and component (6) is sodium alkylbenzene sulfonate and present at about 2.1% by weight; the composition additionally containing 6% by weight of urea.

6. A process for removing stains and soil from fabrics comprising first treating the fabrics with a pre-spotter composition as defined in claim 1 and thereafter laundering said fabrics with detergents.

* * * * *